US007677014B2

(12) United States Patent
Watanabe et al.

(10) Patent No.: US 7,677,014 B2
(45) Date of Patent: Mar. 16, 2010

(54) METHOD FOR PACKAGING A PHOTOSENSITIVE FILM ROLL, RESIN CASE THEREFOR, METHOD FOR RECOVERING AND REUSING THE CASE, AND PHOTOSENSITIVE FILM ROLL PACKAGE AND METHOD FOR CONVEYING THE SAME

(75) Inventors: Yoshihiro Watanabe, Hitachi (JP); Katsutoshi Itagaki, Hitachi (JP); Tomoyuki Haga, Hitachi (JP); Hideaki Tagaya, Hitachi (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 184 days.

(21) Appl. No.: 12/035,233

(22) Filed: Feb. 21, 2008

(65) Prior Publication Data

US 2008/0149514 A1 Jun. 26, 2008

Related U.S. Application Data

(62) Division of application No. 10/451,912, filed as application No. PCT/JP01/11579 on Dec. 27, 2001, now Pat. No. 7,597,195.

(30) Foreign Application Priority Data

Dec. 27, 2000 (JP) ..... 2000-398153

(51) Int. Cl.
*B65B 63/04* (2006.01)
*B65B 11/58* (2006.01)

(52) U.S. Cl. ..... 53/430; 53/449

(58) Field of Classification Search ..... 53/430, 53/449; 206/316.1, 407, 410, 455; 428/36.92; *B65B 63/04*
See application file for complete search history.

(56) References Cited

U.S. PATENT DOCUMENTS

| | | | | |
|---|---|---|---|---|
| 4,293,635 | A * | 10/1981 | Flint et al. | 430/271.1 |
| 4,304,838 | A | 12/1981 | Hasegawa et al. | |
| 4,680,248 | A * | 7/1987 | Roach | 430/270.1 |
| 4,844,961 | A | 7/1989 | Akao | |
| 4,921,737 | A | 5/1990 | Akao | |
| 4,960,626 | A | 10/1990 | Akao et al. | |
| 5,225,259 | A | 7/1993 | Akao | |
| 5,314,786 | A | 5/1994 | Roeschert et al. | |
| 5,660,303 | A | 8/1997 | Hirose | |
| 5,720,389 | A | 2/1998 | Yamazaki et al. | |
| 5,791,473 | A | 8/1998 | Decker et al. | |
| 5,981,048 | A | 11/1999 | Sugimoto et al. | |
| 6,044,623 | A | 4/2000 | Karaki et al. | |
| 6,120,972 | A | 9/2000 | Iwanaga et al. | |
| 6,182,419 | B1 | 2/2001 | Karaki et al. | |
| 6,303,268 | B1 | 10/2001 | Namba et al. | |

FOREIGN PATENT DOCUMENTS

| | | |
|---|---|---|
| CN | 1095914 A | 12/1994 |
| JP | 62-44736 | 2/1987 |
| JP | 63-305351 | 12/1988 |
| JP | 4-267747 | 9/1992 |
| JP | 5-7747 | 1/1993 |
| JP | 5-128590 | 5/1993 |
| JP | 6-27593 | 2/1994 |
| JP | 6-135440 | 5/1994 |
| JP | 8-58863 | 3/1996 |
| JP | 8-207939 | 8/1996 |
| JP | 9-244326 | 9/1997 |
| JP | 10-167333 | 6/1998 |
| JP | 10-265768 | 10/1998 |
| JP | 10-329884 | 12/1998 |
| JP | 11-99192 | 4/1999 |
| JP | 11-171170 A | 6/1999 |
| JP | 11-282131 | 10/1999 |
| JP | 2000-19814 | 1/2000 |
| JP | 2000-25841 A | 1/2000 |
| JP | 2000-72141 | 3/2000 |
| JP | 2000-347391 A | 12/2000 |
| KR | 2000-0014167 | 3/2000 |
| KR | 1995-0002872 | 2/2008 |

OTHER PUBLICATIONS

Office Action received in the corresponding Chinese patent application No. 018214762 mailed Dec. 17, 2004.

Office Action received in the corresponding Japanese patent application No. 2002-552830 issued Dec. 5, 2006.

Office Action issued in related Japanese application No. 2002-552830 dated Sep. 2, 2008.

Kossen, S.P. et al., HPLC Determination of Free Amounts of (Meth)acrylic Monomers in Solvent and Water-born Poly(meth)ac, Nov. 2001, printed Aug. 25, 2008 from http://www.pharmainfo.net/hplc-and-gc-articles.hplc-determination. . . .

Notice of Allowance issued in parent U.S. Appl. No. 10/451,912, mailed May 26, 2009.

* cited by examiner

*Primary Examiner*—Stephen F Gerrity
(74) *Attorney, Agent, or Firm*—Griffin & Szipl, P.C.

(57) ABSTRACT

A method of increasing manufacturing efficiency of printed wiring boards is provided that includes packaging a photosensitive film roll with a resin case, wherein the photosensitive film roll is formed, by winding around a core, a photosensitive film that comprises a supporting film and a photosensitive resin composition layer formed on the supporting film, wherein the photosensitive resin composition layer comprises a photosensitive resin composition that contains a binder polymer and a photopolymerizable compound having at least one polymerizable ethylenically unsaturated group within a molecule and a photopolymerization initiator, and wherein the resin case consists of a resin having a lower surface energy than the photosensitive resin composition.

20 Claims, No Drawings

METHOD FOR PACKAGING A PHOTOSENSITIVE FILM ROLL, RESIN CASE THEREFOR, METHOD FOR RECOVERING AND REUSING THE CASE, AND PHOTOSENSITIVE FILM ROLL PACKAGE AND METHOD FOR CONVEYING THE SAME

This application is a divisional application of U.S. patent application Ser. No. 10/451,912, which was filed on Dec. 30, 2003 as the U.S. National Stage of International Application No. PCT/JP01/11579, filed on Dec. 27, 2001, which claims priority of JP 2000-398153 filed on Dec. 27, 2000. The entire disclosures of the above applications are hereby incorporated by reference.

TECHNICAL FIELD

The present invention relates to a method for packaging a photosensitive film roll, a resin case therefore, a method for recovering and reusing the case, and a photosensitive film roll package and method for conveying the same.

BACKGROUND ART

Photosensitive films are widely used for manufacturing printed wiring boards and the like. Conventionally, in cases where tubular objects such as photosensitive film rolls or the like formed by rolling up photosensitive films are conveyed from packaging departments to users, these tubular objects are packed into cardboard boxes made of paper.

However, once cardboard boxes made of paper have been used, the strength of such boxes drops as a result of damage, absorption of moisture and the like, the used cardboard boxes made of paper have been thrown away as a waste material. Furthermore, in cases where cardboard boxes made of paper are used, auxiliary packaging materials such as strings, adhesive tapes and the like are used in a large amount for fastening the packages, and such materials have also generally been discarded as waste materials in the same manner as the cardboard.

DISCLOSURE OF THE INVENTION

On the other hand, there has been a problem that it is difficult to maintain high yield in the manufacturing process of printed wiring board using a photosensitive film roll.

The present inventors conducted diligent investigations in order to solve these problems. As a result, the inventors discovered that the reason that the yield during manufacture of a printed wiring board cannot be maintained at a high level is that dust such as paper debris and the like adheres to the photosensitive film roll that is used in the manufacture of a printed wiring board. In addition, the inventors found that such adhesion of dust to photosensitive film rolls occurs inside cardboard boxes made of paper in which the photosensitive film rolls are accommodated.

The present invention was devised on the basis of such findings. It is an object of the present invention to provide a method for packaging a photosensitive film roll which lowers the burden on the environment by preventing the generation of trash in cases where photosensitive film rolls are used, and which increases the manufacturing efficiency of printed wiring boards and the like by preventing the adhesion of dust and the like. Furthermore, it is also an object of the present invention to provide a resin case used for photosensitive film roll packaging, a method for recovering and reusing the case, and a photosensitive film roll package and method for conveying the same.

The present invention relates to the following (1)-(29).

(1) A method for packaging a photosensitive film roll, comprising packaging the photosensitive film roll with a resin case.

(2) The method for packaging a photosensitive film roll according to (1), wherein the photosensitive film roll is formed by winding around a core, a photosensitive film that comprises a supporting film and a photosensitive resin composition layer formed on the supporting film.

(3) The method for packaging a photosensitive film roll according to (2), wherein the photosensitive film further comprises a protective film on top of and covering the photosensitive resin composition layer.

(4) The method for packaging a photosensitive film roll according to (3), wherein the photosensitive resin composition layer comprises a photosensitive resin composition that contains a binder polymer, a photopolymerizable compound having at least one polymerizable ethylenically unsaturated group within a molecule and a photopolymerization initiator, and wherein the resin case consists of a resin having a lower surface energy than the photosensitive resin composition.

(5) The method for packaging a photosensitive film roll according to (3), wherein the photosensitive resin composition layer comprises a photosensitive resin composition that contains a binder polymer, a photopolymerizable compound having at least one polymerizable ethylenically unsaturated group within a molecule and a photopolymerization initiator; at least one of the supporting film and the protective film consists of a polyolefin film; and the resin case is a polyolefin case.

(6) The method for packaging a photosensitive film roll according to (5), wherein the polyolefin film and the polyolefin case consist of the same or different polyolefin, and the polyolefin is selected from a group consisting of polyethylene, polypropylene and polyethylene-polypropylene.

(7) The method for packaging a photosensitive film roll according to any of (1)-(6), wherein the photosensitive film roll is disposed inside a plastic bag.

(8) The method for packaging a photosensitive film roll according to (7), wherein the plastic bag is a light blocking plastic bag.

(9) The method for packaging a photosensitive film roll according to (7) or (8), wherein the plastic bag is a polyolefin plastic bag.

(10) The method for packaging a photosensitive film roll according to (9), wherein the polyolefin plastic bag consists of a polyolefin selected from a group consisting of polyethylene, polypropylene and polyethylene-polypropylene.

(11). The method for packaging a photosensitive film roll according to (1), wherein the resin case is a reusable resin case.

(12) The method for packaging a photosensitive film roll according to (1), wherein the resin case is collapsible without any waste materials that must be thrown away after being collapsed.

(13) The method for packaging a photosensitive film roll according to (2), wherein a width of the photosensitive film is from 0.1 to 1 m.

(14) The method for packaging a photosensitive film roll according to (2), wherein a length of the photosensitive film wound around the core is from 10 to 600 m.

(15) A method for packaging a photosensitive film roll, comprising packaging the photosensitive film roll with a reusable case.

(16) The method for packaging a photosensitive film roll according to (15), wherein the photosensitive film roll is formed by winding around a core, a photosensitive film that comprises a supporting film and a photosensitive resin composition layer formed on the supporting film.

(17) The method for packaging a photosensitive film roll according to (16), wherein the photosensitive film further comprises a protective film on top of and covering the photosensitive resin composition layer.

(18) The method for packaging a photosensitive film roll according to (16), wherein a width of the photosensitive film is from 0.1 to 1 m.

(19) The method for packaging a photosensitive film roll according to (16), wherein a length of the photosensitive film wound around the core is from 10 to 600 m.

(20) A method for packaging a photosensitive film roll, comprising packaging the photosensitive film roll is packaged in a case which is collapsible without any waste materials that must be thrown away after being collapsed.

(21) The method for packaging a photosensitive film roll according to (20), wherein the photosensitive film roll is formed by winding around a core, a photosensitive film that comprises a supporting film and a photosensitive resin composition layer formed on the supporting film.

(22) The method for packaging a photosensitive film roll according to (21), wherein the photosensitive film further comprises a protective film on top of and covering the photosensitive resin composition layer.

(23) The method for packaging a photosensitive film roll according to (21), wherein a width of the photosensitive film is from 0.1 to 1 m.

(24) The method for packaging a photosensitive film roll according to (21), wherein a length of the photosensitive film wound around the core is from 10 to 600 m.

(25) A resin case for packaging a photosensitive film roll for accommodating a photosensitive film roll that is formed by winding around a core, a photosensitive film which comprises a supporting film, a photosensitive resin composition layer that is formed on the supporting film, and a protective film that covers the photosensitive resin composition layer, wherein the resin case consists of a resin having a lower surface energy than the photosensitive resin composition.

(26) A package packaged by the method for packaging a photosensitive film roll according to (1)-(24).

(27) A method of conveying a photosensitive film roll, comprising conveying the package according to (26).

(28) A method of recovering a resin case for packaging a photosensitive film roll without disposal, comprising storing for reutilization, the resin case used for the package obtained by the method for packaging a photosensitive film roll according to (1)-(14).

(29) A method of reusing a resin case for packaging photosensitive film roll, comprising reusing the resin case used for the package obtained by the method for packaging a photosensitive film roll according to (1)-(24), at least once for packaging a photosensitive film roll.

BEST MODES FOR CARRYING OUT THE INVENTION

As was described above, the present invention relates to a method for packaging a photosensitive film roll, a resin case therefor, a method for recovery and reuse the case, a photosensitive film roll package and a method for conveying the same. Respective embodiments of these will be described in detail below.

(Method for Packaging a Photosensitive Film Roll)

A method for packaging a photosensitive film roll of the present invention, comprising packaging the photosensitive film roll with a resin case. Specifically, the method for packaging a photosensitive film roll of the present invention is a packaging method in which the photosensitive film roll is disposed inside a packaging container, wherein the packaging container is a resin case.

Since the packaging method of the present invention uses a resin case as a packaging container, this packaging container can be reutilized after the use of the photosensitive film roll. Accordingly, the generation of trash during the use of the photosensitive film roll can be prevented, so that the burden on the environment can be reduced. Furthermore, since the generation of dust and the like inside the packaging container caused by friction between the photosensitive film roll and the packaging container or the like can be prevented, the photosensitive film roll can be maintained in a clean state, so that the manufacturing efficiency of printed wiring boards and the like can be increased.

Examples of the photosensitive film rolls that can be used in the packaging method of the present invention include Photech (commercial name of a product manufactured by Hitachi Chemical Co., Ltd.), Sunfort (commercial name of a product manufactured by Asahi Kasei Corporation), ALPHO, LAMINAR, Dynamask and Conformask (commercial names of products manufactured by Nichigo-Morton Co., Ltd.), Riston (commercial name of a product manufactured by Du Pont MRC Dry Film Ltd.) and the like.

Meanwhile, examples of the resin case include a resin case consisting of a thermoplastic resin such as polyvinyl chloride, polyethylene, polypropylene, polyethylene-polypropylene, polystyrene and the like, and a resin case consisting of a thermosetting resin such as a phenol resin, an urea resin, an epoxy resin, a melamine resin and the like.

Furthermore, it is desirable that the resin case be a resin case that is collapsible without any waste materials that must be thrown away after being collapsed. Conventionally used cardboard made of paper is collapsible. However, when such cardboard is collapsed, it is necessary to discard adhesive tape, staples and the like. In contrast, by using a resin case that is collapsible and creates no waste materials after being collapsed, it becomes possible to reuse the resin case and to reduce the environmental burden due to no generation of waste materials during reuse. Examples of such resin case include Apacon (standard type), Apacon 530, Ecocube, Apacon 25 (commercial names of products manufactured by APPAX Co., Ltd.) and the like.

Furthermore, it is desirable that the resin case is reusable five times or more, preferably 10 times or more, more preferably 15 times or more, more preferably 20 times or more, and most preferably 30 times or more.

A photosensitive film roll that is especially desirable as the photosensitive film roll used in the packaging method of the present invention is formed by winding a photosensitive film that has a supporting film (polyethylene terephthalate film or the like) and a photosensitive resin composition layer that is formed on the supporting film, around a core (e. g., a plastic core consisting of ABS or the like). In the case of such a photosensitive film roll, it is even more desirable that the photosensitive film roll further have a protective film (polyolefin film such as a polyethylene film or the like) that is disposed on top of the photosensitive resin composition layer and that covers the photosensitive resin composition layer. In this case, it is desirable that the width of the photosensitive film be from 0.1 to 1 m, and that the wrapped length of the photosensitive film wound around the core be from 10 to 600 m.

It is desirable that the photosensitive resin composition layer comprises a photosensitive resin composition that contains a binder polymer, a photopolymerizable compound having at least one polymerizable ethylenically unsaturated group within a molecule and a photopolymerization initiator.

Examples of the binder polymers include a polymer that contains a carboxyl group (such as a copolymer of (meth) acrylic acid alkyl ester, (meth) acrylic acid, and a vinyl monomer that is copolymerizable with the foregoing monomers). Examples of the photopolymerizable compound include a compound obtained by reacting α,β-unsaturated carboxylic acids with polyhydric alcohols; a compound obtained by reacting α,β-unsaturated carboxylic acids with a compound containing a glycidyl group, (meth) acrylic acid alkyl ester, a (meth) acrylate compound having an urethane bond within a molecule, and the like. Examples of the photopolymerization initiator include benzophenone, a derivative of benzophenone (such as N,N'-tetramethyl-4,4'-diaminobenzophenone), a dimmer of 2,4,5-triarylimidazole and the like.

When the photosensitive resin composition layer comprises the abovementioned components, the resin case that accommodates the photosensitive film roll preferably consists of a resin having a lower surface energy than the photosensitive resin composition. Ordinarily, a photosensitive resin layer consisting of abovementioned components is soft and exhibits tackiness at room temperature. The photosensitive resin composition layer may adhere to the inner wall of the resin case when the protective film or supporting film is peeled off inside of the resin case. By employing a resin case having a lower surface energy than the photosensitive resin composition, the photosensitive resin composition layer that has adhered to the inner wall is easily peeled off from the inner wall. Accordingly, no fragments of the photosensitive resin composition layer will remain on the inner wall of the resin case, so that contamination of the photosensitive film roll can easily be prevented.

In cases where the photosensitive resin composition layer comprises the abovementioned components, it is desirable that at least one of the supporting film and the protective film (preferably at least the protective film) comprise polyolefin films, and that the resin case be a polyolefin case.

When both supporting film and resin case are made of polyolefin or both protective film and resin case are made of polyolefin, contamination of the photosensitive film roll by dusts and the like can be effectively prevented. This is because such supporting film (or protective film) and resin case are soft and show little difference in hardness, then the generation of dusts and the like can be suppressed even if friction or the like occurs between the supporting film and/or the protective film and the resin case inside the resin case.

When the photosensitive resin composition layer adheres to the inner wall of the resin case due to peeling off of the supporting film or protective film in the resin case, the polyolefin-based resin case can prevent the layer from remaining on the inner wall because of a low surface energy of the polyolefin used for the resin case. Therefore, the contamination of the photosensitive film roll by fragments of the photosensitive resin composition is effectively prevented. In addition, since the polyolefin case is superior in terms of durability, reuse of the case is facilitated, and the generation of waste materials is prevented so that the burden on the environment can be effectively reduced.

The abovementioned polyolefin film and polyolefin case may consist of the same or different polyolefin. Such polyolefin is preferably selected from the group consisting of polyethylene, polypropylene and polyethylene-polypropylene. By employing abovementioned resin as the polyolefin, the generation of dust and the like can be suppressed more effectively, and reuse of the resin case becomes easier.

The photosensitive film roll maybe packaged directly in the resin case, or may be packaged in the resin case in a state in which the photosensitive film roll is placed inside a plastic bag. In this case, it is desirable that the plastic bag be a light blocking plastic bag (black polyethylene bag or the like). By using a light blocking polyethylene bag is used, unnecessary exposure of the photosensitive film roll to incident light can be prevented.

From the standpoint of preventing bleeding of the photosensitive resin composition layer from the edge of the photosensitive film roll (edge fusion), the plastic bag used is preferably the one that has moisture-proof properties (for example, a black polyethylene bag with aluminum layer that is created by vapor deposition).

Furthermore, it is desirable that the plastic bag be a polyolefin plastic bag, and it is even more desirable that the plastic bag be a polyolefin plastic bag consisting of a polyolefin selected from a group consisting of polyethylene, polypropylene and polyethylene-polypropylene. When a plastic bag consisting of a polyolefin is used as the abovementioned plastic bag, the generation of dust or the like caused by friction with the resin case of the like can be effectively prevented.

The especially preferred embodiment of the present invention is a method for packaging a photosensitive film roll, comprising packaging with a resin case the photosensitive film roll that is placed in a plastic bag, wherein the photosensitive film roll is formed by winding around a core, a photosensitive film that comprises a supporting film and a photosensitive resin composition layer formed on the supporting film.

In this case, it is desirable that a protective film that covers the photosensitive resin composition layer in the photosensitive film be placed on top of the photosensitive resin composition layer, and it is desirable that the plastic bag be a light blocking plastic bag. Furthermore, it is desirable that at least one of the supporting film and the protective film be a polyolefin film, that the light blocking plastic bag be a light blocking polyolefin bag, and that the resin case be a polyolefin case. Moreover, the polyolefin film, the light blocking polyolefin bag and the polyolefin case may consist of the same or different polyolefin, and it is extremely desirable that this polyolefin be selected from a group consisting of polyethylene, polypropylene and polyethylene-polypropylene. By employing above-mentioned preferred embodiment, reuse of the resin case is especially facilitated. Accordingly, since the resin case is not thrown way as a waste material, the burden on the environment can be especially reduced. Furthermore, by employing polyolefin for the photosensitive film roll, the plastic bag and the resin case, all of the components become soft and show little difference in hardness. Therefore, there tends to be no generation of dust or the like by friction between the photosensitive film roll and the plastic bag, or friction between the plastic bag and the resin case. Then, even in cases where the photosensitive resin composition layer adheres to the inner surface of the plastic bag, the layer can easily be peeled off from the plastic bag. Consequently, fragments of the photosensitive resin composition layer hardly adhere to the plastic bag. Accordingly, the photosensitive film roll can be maintained in a clean state, so that the manufacturing efficiency of printed wiring boards or the like can be especially increased.

(Resin Case and Method for Recovering and Reusing of The Case)

The resin case that relates to the present invention is a case for packaging a photosensitive film roll for accommodating a photosensitive film roll that is formed by winding around a core, a photosensitive film which comprises a supporting film, a photosensitive resin composition layer that is formed on the supporting film, and a protective film that covers the photosensitive resin composition layer, wherein the resin case consists of a resin having a lower surface energy than the photosensitive resin composition.

The surface energy can be determined as, for example, the critical surface tension $\gamma_c$. When the resin case consists of a resin that has a $\gamma_c$ value lower than the $\gamma_c$ value of the photosensitive resin composition, even in cases where the supporting film or protective film peels inside the resin case so that the photosensitive resin composition layer adheres to the inner walls of the case, fragments of the photosensitive resin composition layer will tend not to adhere to the inside walls of the case, so that the adhesion of fragments of the photosensitive resin composition to the photosensitive film roll can be more easily prevented.

The resin case preferably consists of a resin with a $\gamma_c$ value of 18 to 37 (dyne/cm). The resin case preferably consists of a hydrocarbon resin such as a polyolefin or the like. Preferred polyolefin includes polyethylene, polypropylene and polyethylene-polypropylene. As described above, it is desirable that the resin case be collapsible without any waste materials that must be thrown away after being collapsed.

The method of recovering a resin case for packaging a photosensitive film roll without disposal, that relates to the present invention, is a method comprising storing for reutilization, the resin case used for the package obtained by the above-mentioned method for packaging a photosensitive film roll.

The method of reusing a resin case for packaging photosensitive film roll, that relates to the present invention, is a method comprising reusing the resin case used for the package obtained by the above-mentioned method for packaging a photosensitive film roll, at least once in packaging a photosensitive film roll.

By using the recovery method and reuse method, it is possible to prevent the generation of trash when the photosensitive film roll is used, and thus to reduce the burden on the environment.

(Photosensitive Film Roll Package and Conveying Method)

The package that relates to the present invention is a package packaged by the abovementioned method for packaging a photosensitive film roll. The preferred package is the one that comprises a resin case and a photosensitive film roll stored therein, the photosensitive film roll being formed by winding around a core, a photosensitive film that comprises a supporting film, a photosensitive resin composition layer formed on the supporting film, and a protective film covering the photosensitive resin composition layer.

In this case, it is desirable that the photosensitive film roll be placed in a plastic bag and then packaged in the resin case. Furthermore, it is desirable that the supporting film, protective film, resin case and plastic bag consist of polyolefin.

The method of conveying a photosensitive film roll, that relates to the present invention, is a method comprising conveying the above-mentioned package. In this method, adhesion of dusts or the like to the photosensitive film roll is prevented during conveying. Accordingly, the photosensitive film roll can be maintained in a clean state, so that the manufacturing efficiency of printed wiring boards or the like can be increased.

EXAMPLE

A photosensitive film roll (Product name: Photech, commercially available from Hitachi Chemical Co., Ltd.), formed by winding around a core, a photosensitive film which has a supporting film (polyethylene terephthalate film), a photosensitive resin composition layer formed on the supporting film, and a protective film (polyethylene film) that covers the photosensitive resin composition layer, was placed in a black polyethylene bag, and was placed in a resin case consisting of a polypropylene (Product name: Apacon 530, commercially available from Appax), thus producing a package (A1). Packages (A2)-(A10) were similarly prepared, thus producing a total of 10 packages (A1 through A10). In this case, the surface energy of the resin making up the resin case was smaller than the surface energy of the photosensitive resin composition.

Then, the package (A2), package (A3), package (A4) and package (A5) were successively stacked on top of the package (A1). Similarly, the package (A7), package (A8), package (A9) and package (A10) were successively stacked on top of the package (A6). Two stacks were made each consisting five packages. Then, these packages were placed out of doors for one month in a place with good ventilation but where the packages were not directly exposed to rain. Afterward, the photosensitive film rolls were removed from the packages (A1-A10).

The ten resin cases that were used for above exposure were again packaged with the photosensitive film rolls (same as above). Ten packages obtained were exposed in the same manner as described above. Then, this exposure testing was repeated 30 times in the same manner.

After 30 repetitions, the resin cases were found to be reusable. Furthermore, the resin cases generated no dust during testing.

COMPARATIVE EXAMPLE

An exposure test was performed in the same manner as in the example, except that paper cardboard boxes were used instead of the resin cases. As a result, deformation of the cardboard box due to moisture and weight was observed during the first exposure testing. During the second exposure testing, the stacks of five packages collapsed.

Furthermore, the cardboard boxes generated paper debris during testing.

INDUSTRIAL APPLICABILITY

In the method for packaging a photosensitive film roll of the present invention, since reuse is possible, the generation of waste materials during the use of the photosensitive film can be reduced. Furthermore, recycling (re-utilization) of raw materials from the case is possible, so that the burden on the environment can be reduced. Moreover, this method for packaging a photosensitive film roll is an environment-responsive method that is superior in terms of durability, repeatability, conveying characteristics and recovery efficiency. Moreover, since there is little generation of dust such as paper debris and the like, the yield and stability in the manufacture of printed wiring boards are superior.

The invention claimed is:

1. A method of increasing manufacturing efficiency of printed wiring boards, comprising the steps of:

packaging a photosensitive film roll with a resin case;

wherein the photosensitive film roll is formed, by winding around a core, a photosensitive film that comprises a supporting film and a photosensitive resin composition layer formed on the supporting film, wherein the photosensitive resin composition layer comprises a photosensitive resin composition that contains:

a binder polymer that is a copolymer comprising components selected from the group consisting of (i) at least methacrylic acid alkyl ester and methacrylic acid as monomers, (ii) at least methacrylic acid alkyl ester and acrylic acid as monomers, (iii) at least acrylic acid alkyl ester and methacrylic acid as monomers, and (iv) at least acrylic acid alkyl ester and acrylic acid as monomers, and a photopolymerizable compound having at least one polymerizable ethylenically unsaturated group within a molecule and a photopolymerization initiator, and wherein the resin case consists of a resin having a lower surface energy than the photosensitive resin composition.

2. A method as recited by claim 1, wherein the surface energy of the resin of the resin case is 18 to 37 dyne/cm, and the photosensitive resin composition layer is soft and exhibits tackiness at room temperature and the photosensitive film is suitable for use in manufacturing a printed wiring board.

3. A method as recited by claim 1, wherein the photosensitive film is suitable for use in manufacturing a printed wiring board.

4. A method as recited by claim 1, wherein the photosensitive film further comprises a protective film on top of and covering the photosensitive resin composition layer.

5. A method as recited by claim 4, wherein at least one of the supporting film and the protective film consist of a polyolefin film; and the resin case is a polyolefin case.

6. A method as recited by claim 5, wherein the polyolefin film and the polyolefin case consists of the same or different polyolefins, and the polyolefins are selected from a group consisting of polyethylenes, polypropylenes and polyethylene-polypropylenes.

7. A method as recited by claim 1, wherein the binder polymer is a copolymer comprising at least methacrylic acid alkyl ester and methacrylic acid as monomers.

8. A method as recited by claim 7, wherein the binder polymer further comprises a vinyl monomer.

9. A method as recited by claim 1, wherein the resin case is a reusable and collapsible resin case that is collapsible without generating any waste materials that must be thrown away after the case is collapsed, and the method further comprises the step of:

after using the photosensitive film roll to manufacture a printed wiring board, collapsing the reusable resin case without generating any waste materials.

10. A method as recited by claim 9, wherein when the reusable resin case is collapsed, no dust is generated.

11. A method as recited by claim 10, further comprising the step of:

reusing the resin case to package another photosensitive film roll.

12. A method as recited by claim 9, further comprising the step of:

reusing the resin case to package another photosensitive film roll.

13. A method as recited by claim 1, further comprising the step of:

disposing the photosensitive film roll inside a light blocking plastic bag when packaging the photosensitive film roll with the resin case.

14. A method as recited by claim 13, wherein the plastic bag is a polyolefin plastic bag.

15. A method as recited by claim 14, wherein the polyolefin plastic bag consists of a polyolefin selected from a group consisting of polyethylenes, polypropylenes and polyethylene-polypropylenes.

16. A method as recited by claim 1, wherein the resin case is a reusable and collapsible resin case that is collapsible without generating any waste materials that must be thrown away after the case is collapsed, and the method further comprises the step of:

unpackaging the photosensitive film roll and using the photosensitive film roll to manufacture a printed wiring board, and collapsing the reusable resin case without generating any waste materials.

17. A method as recited by claim 16, wherein when the reusable resin case is collapsed, no dust is generated.

18. A method as recited by claim 16, further comprising the step of:

reusing the resin case to package another photosensitive film roll.

19. A method of increasing manufacturing efficiency of printed wiring boards, comprising the steps of:

(a) forming a first photosensitive film roll by winding, around a core, a photosensitive film comprising a supporting film and a photosensitive resin composition layer formed on the supporting film, wherein the photosensitive resin composition layer is soft and exhibits tackiness at room temperature and the photosensitive film is suitable for use in manufacturing a printed wiring board;

(b) packaging the first photosensitive film roll with a reusable resin case, wherein the resin case is collapsible without generating any waste materials that must be thrown away after the case is collapsed;

(c) unpackaging the first photosensitive film roll and using the first photosensitive film roll to manufacture a first printed circuit board, and collapsing the resin case without generating any waste materials including dust; and (d) reusing the resin case to package a second photosensitive film roll suitable for use in manufacturing a printed wiring board, wherein the photosensitive resin composition layer comprises a photosensitive resin composition containing a binder polymer and a photopolymerizable compound having at least one polymerizable ethylenically unsaturated group within a molecule and a photopolymerization initiator; and wherein the resin case consists of a resin having a lower surface energy than the photosensitive resin composition and the binder polymer is a copolymer comprising components selected from the group consisting of (i) at least methacrylic acid alkyl ester and methacrylic acid as monomers, (ii) at least methacrylic acid alkyl ester and acrylic acid as monomers, (iii) at least acrylic acid alkyl ester and methacrylic acid as monomers, and (iv) at least acrylic acid alkyl ester and acrylic acid as monomers, and the surface energy of the resin of the resin case is 18 to 37 dyne/cm.

20. A method as recited by claim 19, further comprising the step of:

(e) unpackaging the second photosensitive film roll and using the second photosensitive film roll to manufacture a second printed circuit board.

* * * * *